US007819067B2

(12) United States Patent
Early

(10) Patent No.: US 7,819,067 B2
(45) Date of Patent: Oct. 26, 2010

(54) HOPPER CAR GATE WITH A CURVED DOOR

(75) Inventor: Stephen R. Early, Johnson, KS (US)

(73) Assignee: Aero Transportation Products, Inc., Independence, MO (US)

( * ) Notice: Subject to any disclaimer, the term of this patent is extended or adjusted under 35 U.S.C. 154(b) by 293 days.

(21) Appl. No.: 12/077,899

(22) Filed: Mar. 21, 2008

(65) Prior Publication Data

US 2009/0235840 A1 Sep. 24, 2009

(51) Int. Cl.
*B61D 7/20* (2006.01)
*B61D 7/24* (2006.01)

(52) U.S. Cl. ..... 105/282.3; 105/282.1; 105/289

(58) Field of Classification Search ..... 105/280, 105/282.1, 282.2, 282.3, 286, 288, 289; 298/24, 298/27, 33, 35 M
See application file for complete search history.

(56) References Cited

U.S. PATENT DOCUMENTS 1,627,256 A * 5/1927 Smith ..... 105/248
2,989,930 A * 6/1961 Flowers ..... 105/248
4,149,470 A * 4/1979 Sambucetti et al. ..... 105/282.3
4,325,308 A * 4/1982 Erfurth ..... 105/280
4,574,989 A 3/1986 Pole
5,263,422 A * 11/1993 Barefoot ..... 105/308.1
6,363,863 B1 * 4/2002 Dohr ..... 105/247
2009/0007813 A1 1/2009 Early

OTHER PUBLICATIONS

U.S. Appl. No. 12/265,117, Stephen R. Early.

* cited by examiner

*Primary Examiner*—S. Joseph Morano
*Assistant Examiner*—Zachary Kuhfuss
(74) *Attorney, Agent, or Firm*—Stinson Morrison Hecker LLP

(57) ABSTRACT

A hopper car gate with a curved door for discharging cargo from a hopper car. The gate has coupled side walls and end walls which present a top opening, bottom opening, and upper surface surrounding the top opening and adapted to be joined to the hopper car. A curved rail extends between and is coupled with the end walls adjacent the bottom opening. A curved door is supported on the rail. The door is moveable between a closed position which blocks the bottom opening and an open position which allows the cargo to exit through the bottom opening.

19 Claims, 4 Drawing Sheets

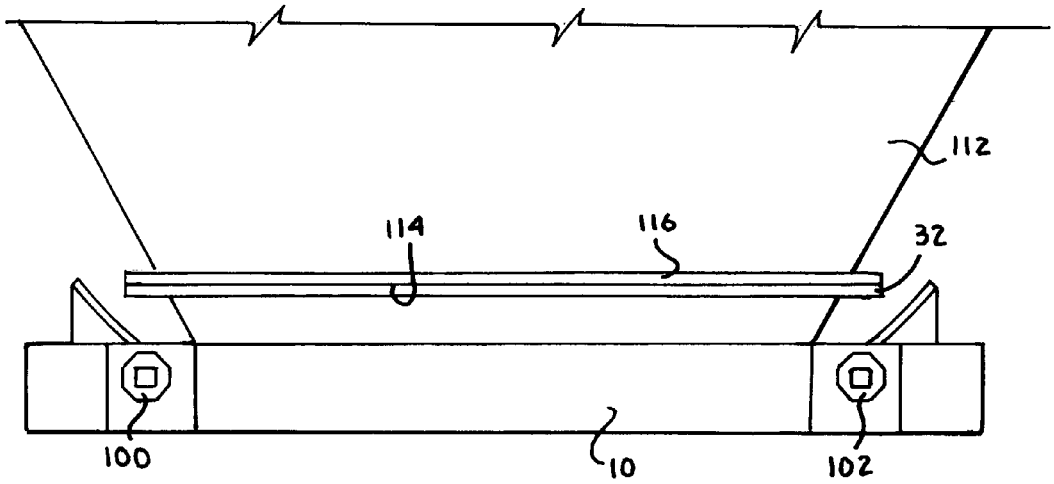
Fig.6.
Fig.7.
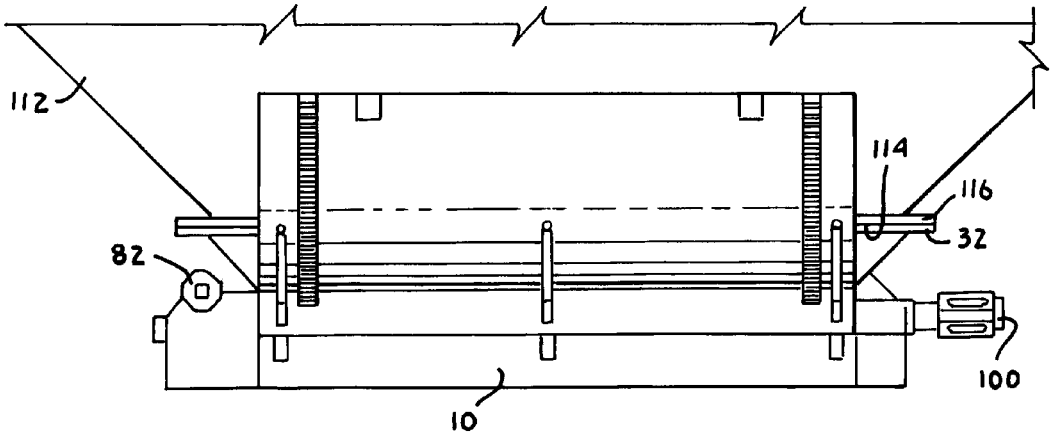

HOPPER CAR GATE WITH A CURVED DOOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is related in general to a hopper car for carrying bulk materials and more particularly to a hopper car gate with a curved door.

2. Description of Related Art

Hopper cars are commonly used to transport bulk materials. Hopper cars include one or more hoppers which hold bulk materials or other cargo for shipment. Each hopper has a discharge opening at its bottom in order to discharge the cargo upon arrival at its intended destination. A gate is joined to each opening to control the discharge of cargo from the hopper. Typically, the gate will have a frame defining an opening and a door moveable between a closed position which blocks the opening and an open position which allows cargo to exit through the opening. An opening mechanism allows a user to move the door between its closed and open positions.

The hopper openings must be spaced a distance sufficient to allow clearance for opening the doors of the gates joined to the openings. Between adjacent hopper openings there are sloped hopper surfaces to facilitate discharge of the cargo within the hoppers. The area beneath the sloped surfaces is wasted space. Reducing the spacing between adjacent hopper openings reduces the wasted space beneath the sloped hopper surfaces, thus increasing the hopper car's carrying capacity. The length or width of hopper cars cannot be increased to increase carrying capacity because there are maximum exterior dimensions to which hopper cars must conform. For example, the Association of American Railroads (AAR) establishes maximum clearance dimensions for all railcars including hopper cars. It is important to maximize a hopper car's carrying capacity while ensuring the car has dimensions within the specified maximum clearance dimensions.

Hopper gate doors must be sufficiently stiff to resist bending from the high pressure exerted on the doors by the cargo contained within the hopper. It is difficult to increase the size of a hopper door, and therefore a hopper opening, without the stiffness of the door being reduced below an unacceptable level. There are a variety of locking mechanisms which are operable to ensure that a door will not open due to impact on the hopper car during transport. These mechanisms increase the complexity and cost of manufacturing a hopper car gate.

BRIEF SUMMARY OF THE INVENTION

The present invention is directed toward a hopper car gate having at least one curved door for discharging cargo from a hopper car. The hopper car has one or more hoppers, each having an opening and a rim surrounding the opening. The hopper car gate is joined to the rim.

In one embodiment, the hopper car gate has opposed generally upright side walls and opposed generally upright end walls coupled with the side walls. The coupled side and end walls present a top opening, a bottom opening, and an upper surface surrounding the top opening and adapted to be joined to the rim surrounding the hopper's opening. A curved rail extends between and is coupled with the end walls adjacent the bottom opening. The rail supports a curved door moveable between a closed position which blocks the bottom opening and an open position which allows the cargo to exit through the bottom opening.

The door curvature allows closer spacing between adjacent gates because it eliminates interference between adjacent gates. Because the door curvature allows closer spacing between adjacent gates, a hopper car with a curved door may have a greater carrying capacity than hopper cars with conventional gates. The curvature also allows the door to open toward the side of a hopper car while still remaining within the AAR clearance zone. If the doors open to the side of a hopper car, then the spacing between adjacent hopper gates may be eliminated thus greatly increasing the car's carrying capacity over that of a conventional hopper car. The curvature also increases the door's stiffness, which allows for larger doors covering larger openings. A car with larger openings may have an increased carrying capacity over that of a conventional hopper car because fewer hoppers are required. The curved door also reduces the need for a lock to retain the door in a closed position when subject to braking and car positioning impacts because the door must be moved upwards to open.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 6 is a fragmentary side elevational view showing the gate of FIG. 1 joined to the rim surrounding a hopper opening; and FIG. 7 is a fragmentary side elevational view showing the gate of FIG. 1 rotated 90 degrees from the gate of FIG. 6 and joined to the rim surrounding a hopper opening.

DETAILED DESCRIPTION OF PREFERRED EMBODIMENT

Figure 1:
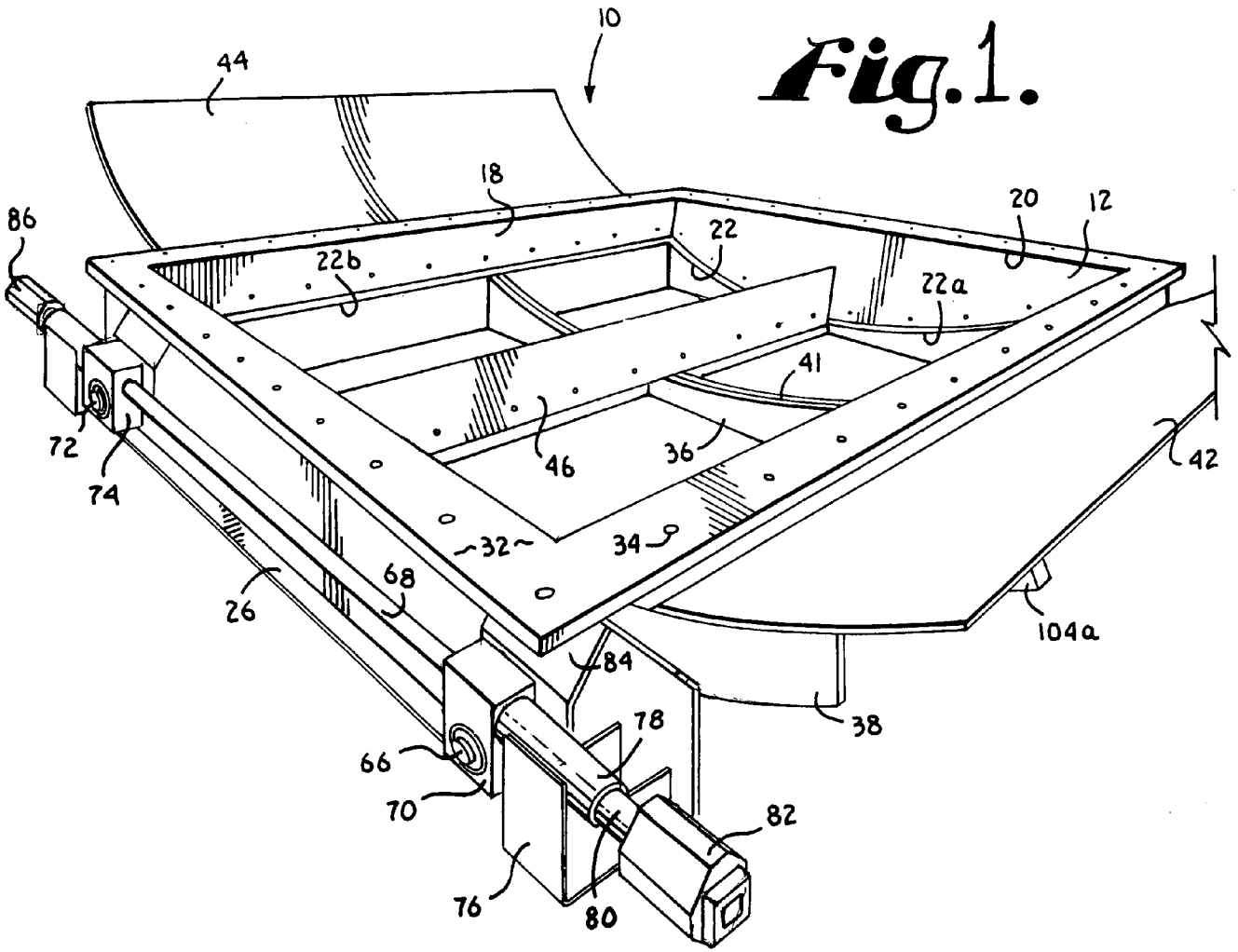
FIG. 1 is a perspective view of a hopper car gate with curved doors according to an embodiment of the present invention.
Figure 2:
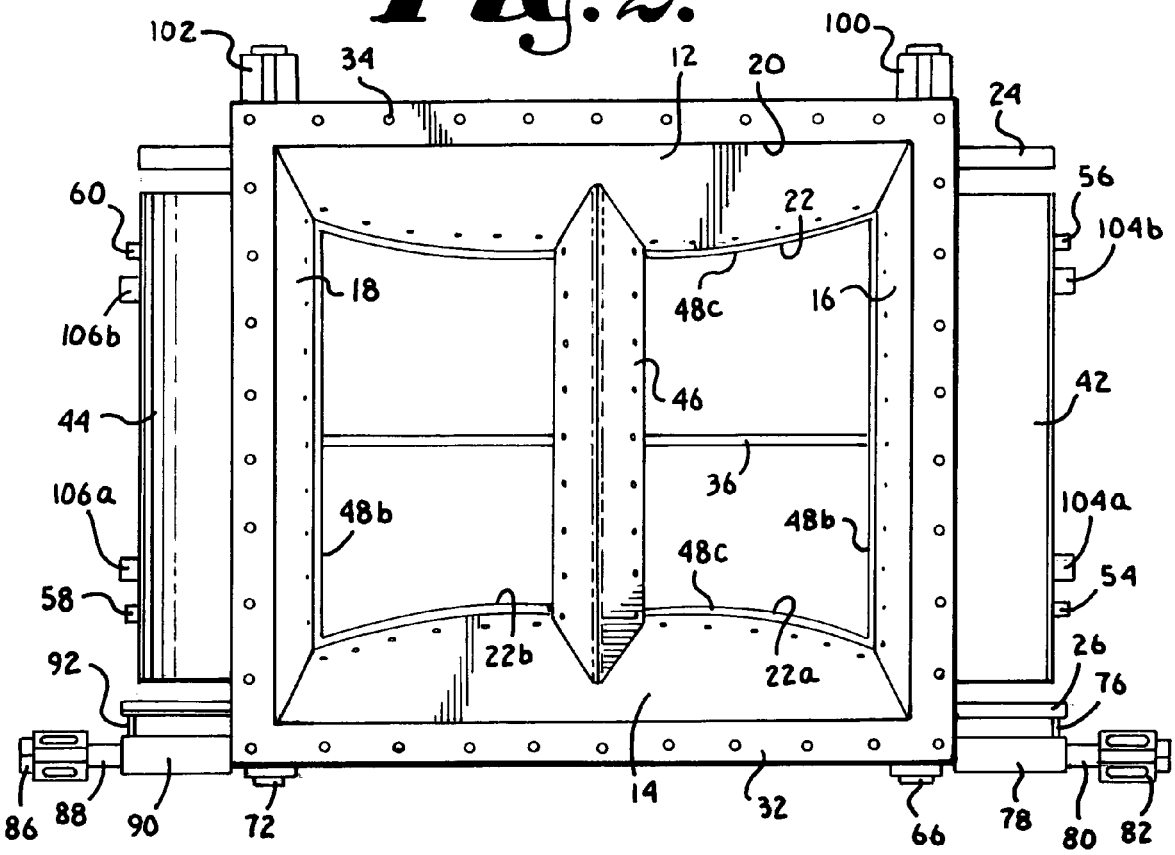
FIG. 2 is a top plan view of the gate of FIG. 1.
Figure 3:
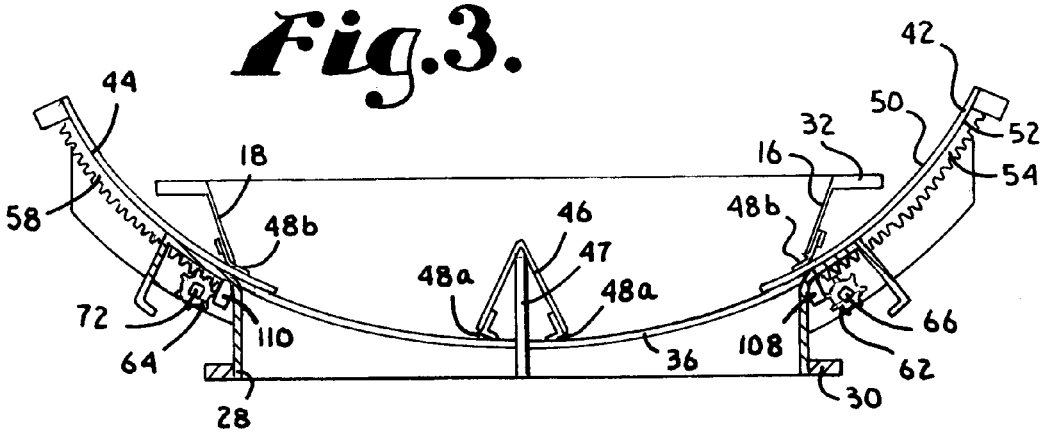
FIG. 3 is a side cross-sectional view, showing both doors in an open position.

A hopper car gate 10 with curved doors 42 and 44 is shown in FIG. 1. FIG. 2 shows gate 10 with opposed generally upright side walls 12 and 14 joined with opposed generally upright end walls 16 and 18. The joined walls present a top opening 20 surrounded by upper surfaces of the joined walls, and a bottom opening 22 which is slightly smaller than top opening 20 because of the angled nature of the walls. Side frame members 24 and 26, shown in FIG. 2, support and are joined with side walls 12 and 14, and end frame members 28 and 30, shown in FIG. 3, are joined with side frame members 24 and 26 for increasing the rigidity of the frame. A flange 32 is joined with the upper surface of side walls 12, 14 and end walls 16, 18 adjacent top opening 20. The flange has generally equidistant spaced holes 34 which receive fasteners to join the gate to a hopper car. Although the gate is shown with a flange, it is within the scope of the invention for the gate to not have a flange and for the upper surfaces of the joined walls to be joined with the hopper car by welding or any other means known in the art.

Figure 4:
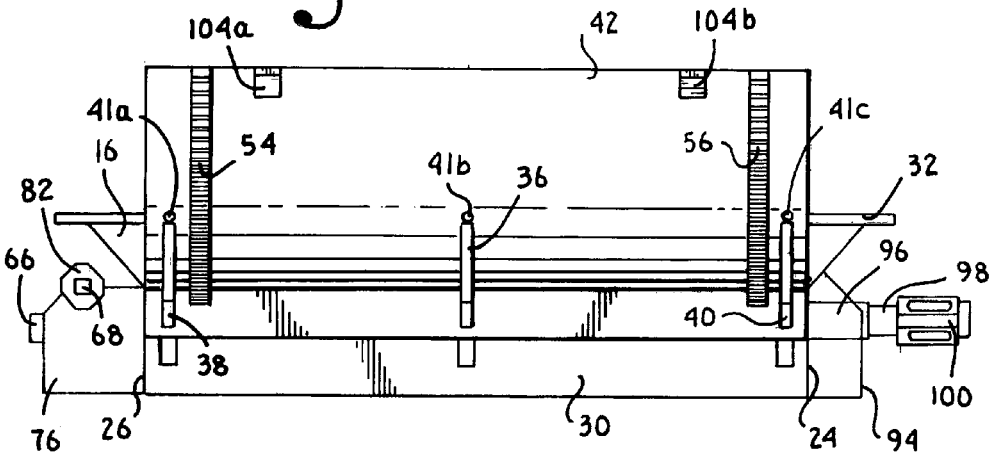
FIG. 4 is a front elevational view of the gate of FIG. 1.

Referring to FIG. 1, a curved rail 36 is rigidly mounted on end frame members 28 and 30 and extends between the centers of walls 16 and 18. There are two additional rails 38 and 40, shown in FIG. 4, which are substantially identical to rail 36 and extend between the ends of walls 16 and 18. As shown in FIG. 4, all three rails 36, 38 and 40 extend beyond end wall 16, and although not shown, the rails extend beyond end wall 18 in a similar manner. A circular rod 41*a-c* is welded to the top of each rail, as shown in FIG. 4. The rods present a low friction glide surface that facilitates opening and closing the doors. The rods may be made of bronze or a similar material which generates a relatively low amount of friction with the door. Although the rails are shown as being substantially identical, it is within the scope of the invention for the rails to have differing configurations.

Rails 36, 38 and 40 support first and second curved doors 42 and 44, shown in FIG. 1. The curved doors are moveable between the open position shown in FIGS. 1 and 3 and the closed position shown in FIG. 5. In the open position cargo can exit through bottom opening 22, and in the closed position the doors block the bottom opening. When in its closed position first door 42 blocks a first section 22*a* of bottom opening 22 and second door 44 blocks a second section 22*b* of the bottom opening when in its closed position. As shown in FIG. 3, at least a portion of each of doors 42 and 44 is above flange 32 when the doors are in their open positions, however, it is within the scope of the invention for the doors to not open to a position that is above the flange. FIG. 3 shows rail 36 extending beyond end frame members 28 and 30 to support doors 42 and 44 in the open position. As shown in FIG. 4, rails 38 and 40 also extend beyond end frame member 30 to support door 42 when the door is in its open position. Rails 38 and 40 also extend beyond end frame member 28 to support door 44 when the door is in its open position. Although the gate is shown with two curved doors, it is within the scope of the invention for the gate to have more or less than two curved doors, for example the gate could have one curved door which blocks the entire bottom opening when in its closed position.

Figure 5:
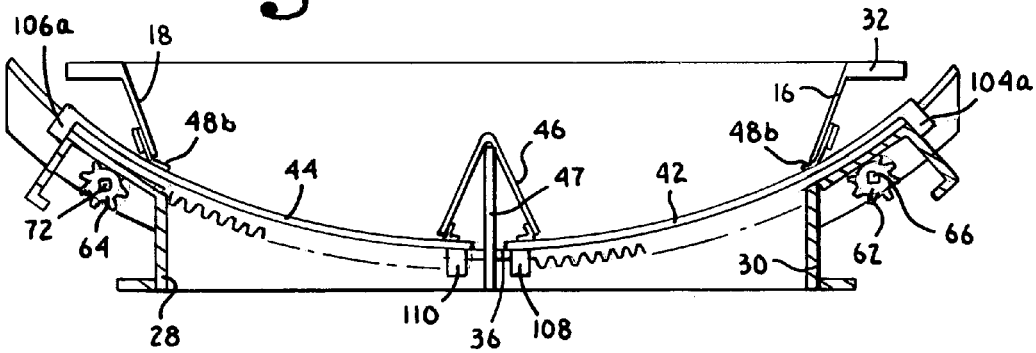
FIG. 5 is a side cross-sectional view of the gate of FIG. 1 showing both doors in a closed position.

The gate has a cover 46, shown in FIG. 2, extending between and joined with side walls 12 and 14. The cover overlies the adjacent leading edges of doors 42 and 44 when the doors are in the closed position, as shown in FIG. 5. The cover protects the leading edges of the doors and is shaped to facilitate the discharge of cargo through the bottom opening. FIG. 3 shows a center frame member 47 beneath cover 46, which member is joined with and extends between side frame members 24 and 26 for improving the frame's rigidity. FIG. 3 shows a flexible seal 48*a* joined with each side of the cover. As shown in FIG. 2, a flexible seal 48*b* is also joined with each end wall, and a flexible seal 48*c* is joined with each side wall. Seals 48*a-c* prevent cargo from leaking through opening 22 when the doors are in their closed position. The seals are preferably constructed from ultra high molecular weight polyethylene, but it is within the scope of the invention to construct the seals from a different material. Although the gate is shown with a center cover and supporting frame member, it is within the scope of the invention for the gate to not have this structure if the rails provide the gate frame with sufficient rigidity and the mating edges of the doors present a seal to prevent commodity from leaking through the doors when in a closed position.

As shown in FIG. 3, door 42 has a top surface 50 and a bottom surface 52. There are two gear racks 54 and 56, shown in FIG. 4, mounted on the bottom surface of door 42. Two gear racks 58 and 60, shown in FIG. 2, are also mounted on the bottom surface of door 44. Each gear rack extends the length of the door it is mounted on in a direction aligned with the direction of movement of the door. Each rack has a plurality of teeth as best seen in FIG. 3. Although the gear racks are mounted to the bottom surfaces of the doors, it is within the scope of the invention for the gear racks to be mounted on the top surfaces of the doors.

The gate has four gears each having a plurality of gear teeth that are successively engageable with the teeth on one of the racks. Two of the gears 62 and 64 are shown in FIG. 3. First gear 62 is mounted on a first drive shaft 66, which extends between walls 12 and 14 in a direction perpendicular to the direction of movement of door 42. First gear 62 is engaged with gear rack 54. A second drive shaft 68, shown in FIG. 1, extends in a direction perpendicular to first drive shaft 66. A first right angle gear box 70 couples first and second drive shafts 66 and 68. A third drive shaft 72, shown in FIG. 3, extends between walls 12 and 14 in a direction that is perpendicular to second drive shaft 68. Second gear 64 is mounted on third drive shaft 72 and is engaged with gear rack 58. A second right angle gear box 74, shown in FIG. 1, couples second and third drive shafts 68 and 72. There is a third gear (not shown) mounted on first drive shaft 66 which is engaged with gear rack 56, and a fourth gear (not shown) mounted on third drive shaft 72 which is engaged with gear rack 60.

Although not shown, it is within the scope of the invention for the gate to have a fourth drive shaft extending between walls 16 and 18 on the opposite side of the gate as second drive shaft 68. It is also within the scope of the invention to move one of the right angle gear boxes 70 or 72 to the opposite end of the respective first or third drive shaft 66 or 72, such that the moved gear box couples the optional fourth drive shaft with either the first or third drive shaft. In this configuration, the second drive shaft would be used to operate one door and the fourth drive shaft the other door. Using a fourth drive shaft to operate one of the doors reduces the operating torque on the second drive shaft.

First right angle gear box 70 is preferably configured for right hand drive such that second drive shaft 68 rotates clockwise (when viewed from FIG. 4) resulting in clockwise rotation (viewed from FIG. 3) of first drive shaft 66. Second right angle gear box 74 is preferably configured for left hand drive such that third drive shaft 72 rotates counterclockwise (when viewed from FIG. 3) with clockwise rotation (viewed from FIG. 4) of second drive shaft 68. The right angle gear boxes or gear sets may use worm gears, helical gears, bevel gears, hypoid gears, or any other set of gears operable to transfer torque between perpendicular shafts. One suitable right angle gear box is sold under the trademark Slide-Rite by Tolomatic, Inc. of Hamel, Minn.

As shown in FIG. 1, a support structure 76 extends from side frame member 26 and is welded to a bearing sleeve 78. A coaxial shank 80 is received by sleeve 78. The shank has an integral socket 82 at its outer end. Second drive shaft 68 is secured to shank 80 such that it rotates with shank 80 and socket 82. Sleeve 78 houses a bearing (not shown) which prevents deflection of shaft 68. The opposite end of second drive shaft 68 has a similar configuration as described above. As shown in FIG. 2, there is a socket 86 integral with a coaxial shank 88, a bearing sleeve 90 houses a bearing (not shown) for preventing deflection of shaft 68, and a support structure 92 is welded to bearing sleeve 90. Referring now to FIG. 1, a support structure 84 extends outward from side frame member 26 and is welded to another bearing sleeve (not shown) positioned between the side frame member and the support structure. This bearing sleeve (not shown) houses a bearing which prevents deflection of first drive shaft 66. Although not shown, there is also a similar support structure, bearing sleeve and bearing behind gearbox 74 for preventing deflection of shaft 72.

FIG. 4 shows a support structure 94 extending from side frame member 24. A bearing sleeve 96 is welded to support structure 94. Bearing sleeve 96 receives a coaxial shank 98 which has an integral socket 100. Shank 98 is coupled with first drive shaft 66, shown in FIG. 3, such that the drive shaft rotates with shank 98 and socket 100. Bearing sleeve 96 houses a bearing (not shown) for preventing deflection of shaft 66. Although not shown, there is a support structure, bearing sleeve and bearing on the opposite side of the gate for supporting third drive shaft 72. FIG. 2 shows a socket 102 which is integral with a shank (not shown) that is coupled with third drive shaft 72 such that the drive shaft rotates with the shank and socket. Sockets 100 and 102 may be used as an emergency drive if one of gear boxes 70, 74 fails.

Two stoppers 104*a,b,* shown in FIG. 4, are mounted on the bottom surface of door 42. Two stoppers 106*a,b,* shown in FIG. 2, are mounted on the bottom surface of door 44. Stoppers 104*a,b* abut end frame member 30 when door 42 is in its closed position, and stoppers 106*a,b* abut end frame member 28 when door 44 is in its closed position for preventing the doors from moving beyond the frame members when closing. FIG. 5 shows stopper 104*a* abutting end frame member 30 and stopper 106*a* abutting end frame member 28. A stopper 108, shown in FIG. 3, is mounted on the bottom surface of door 42 for preventing the door from moving beyond first gear 62 when opening. Likewise, a stopper 110 is mounted on the bottom surface of door 44 for preventing the door from moving beyond second gear 64 when opening. There is an additional stopper (not shown) mounted on the bottom surface of each of doors 42 and 44 for preventing the doors from moving beyond the third and fourth gears (not shown) when opening.

FIG. 6 shows gate 10 joined with a cargo containing hopper 112. Hopper 112 has an opening 114 and a rim 116 surrounding the opening. Flange 32 is joined to rim 116. Preferably, the rim has a plurality of holes (not shown) which align with flange holes 34, shown in FIG. 1. The aligned holes receive fasteners securing the gate to the hopper. In FIG. 6, the gate is mounted to the hopper such that the open position of the doors is between adjoining hoppers on the car. Thus, the doors move to the left and right of a person viewing the hopper car from its side. The curved doors extend upwards along the angled contour of the hopper which enables closer spacing of gates without interference between open doors of adjacent gates. In this mounting configuration, shaft 68 and right angle gear boxes 70 and 74 are not necessary because sockets 100 and 102 are used to open and close first and second doors 42 and 44 respectively. Accordingly, there may be additional sockets (not shown) mounted on the ends of shafts 66 and 68 opposite sockets 100 and 102 for opening and closing the doors from the other side of the gate.

FIG. 7 shows an alternate mounting of gate 10 to hopper 112. In FIG. 7, the gate is mounted to the hopper such that the doors move toward the side walls of the hopper. Thus, the doors move toward and away from a person viewing the hopper car from its side. Because there is no interference between open doors on adjacent gates, the opening along the bottom of the car could be continuous. Preferably, the door curvature ensures that the door remains within the Association of American Railroads clearance zone and that there is sufficient space to access drive sockets 82 and 86 when the doors are in the open position.

In operation, when gate 10 is mounted as shown in FIG. 6, the gate is opened by inserting an opening tool into each of sockets 100 and 102 for rotating the sockets. Socket 100 is rotated in a counterclockwise direction and socket 102 is rotated in a clockwise direction, as shown in FIG. 6. Counterclockwise rotation of socket 100 rotates first drive shaft 66 and the gears mounted thereon in a counterclockwise direction, which drives the racks mounted on door 42 to the left, as shown in FIG. 6, and slides door 42 from its closed position to its open position. Likewise, clockwise rotation of socket 100 rotates third drive shaft 72 and the gears mounted thereon in a clockwise direction, which drives the racks mounted on door 44 to the right, as shown in FIG. 6, and slides door 44 from its closed position to its open position.

When the doors are in the open position, the cargo contained within hopper 112, shown in FIG. 6, is released from the hopper. After the cargo is released, socket 100 is rotated in a clockwise direction to close door 42 and socket 102 is rotated in a counterclockwise direction to close door 44.

To open gate 10 when it is mounted as shown in FIG. 7, an opening tool is inserted in socket 82 to rotate the socket. Socket 82 is rotated in a clockwise direction, as viewed in FIG. 7, to open doors 42 and 44. When socket 82 is rotated clockwise, shank 80 and second drive shaft 68 also rotate clockwise. First right angle gear box 70 rotates first drive shaft 66 clockwise, as viewed from FIG. 3, due to the rotation of second drive shaft 68, and second right angle gear box 74 rotates third drive shaft 72 counterclockwise, as viewed from FIG. 3, due to the second drive shaft's rotation. The clockwise rotation of first drive shaft 66 rotates gear 62 clockwise, and the counterclockwise rotation of third drive shaft 72 rotates gear 64 counterclockwise. The clockwise rotation of gear 62 drives rack 54 to the right, as viewed from FIG. 3, thereby sliding door 42 from its closed position to its open position. The counterclockwise rotation of gear 64 drives rack 58 to the left, as viewed from FIG. 3, thereby sliding door 44 from its closed position to its open position. The third and fourth gears (not shown) drive racks 56 and 60 in the same manner that first and second gears 64 and 66 drive racks 54 and 58.

When the doors are in the open position, the cargo contained within hopper 112, shown in FIG. 7, is released from the hopper. After the cargo is released, socket 82 is rotated in a counterclockwise direction to close both doors. If desired, any of sockets 86, 100, or 102, shown in FIG. 2, may be rotated to open and close the doors. Socket 102 rotates in the same directions as socket 82 to open and close the doors. Sockets 86 and 100 must be rotated in a counterclockwise direction to open the doors, and a clockwise direction for closing.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense. Even though the bottom opening of the gate is shown smaller than the top opening, it is within the scope of the invention for the bottom opening to have the same size as or be larger than the top opening. The flange holes are generally equidistant, but it is within the scope of the invention for the holes to be spaced in a different manner. It is also within the scope of the invention for there to be no cover or underlying support member.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate for discharging cargo from a hopper car, said car comprising a hopper having an opening and a rim surrounding said opening, said gate comprising:

opposed generally upright side walls;

opposed generally upright end walls coupled with said side walls, wherein said coupled side and end walls present a top opening, a bottom opening, and an upper surface surrounding said top opening, wherein said upper surface is adapted to be joined to the rim of the car;

side frame members supporting and coupled with each of said side walls;

end frame members extending between and coupled with said side frame members;

a center frame member extending between and coupled with said side frame members;

a curved rail extending between and coupled with said end frame members adjacent said bottom opening; and a curved door supported on said rail and moveable between a closed position which blocks said bottom opening and an open position which allows the cargo to exit through said bottom opening.

2. The gate of claim 1, wherein said bottom opening comprises first and second sections and said curved door comprises a first curved door that blocks said first section when in its closed position, said gate further comprising a second curved door supported on said rail and moveable in the opposite direction from said first curved door between a closed position which blocks said second section of said bottom opening and an open position which allows the cargo to exit through said second section of said bottom opening.

3. The gate of claim 2, wherein said first and second curved doors present leading edges which are adjacent when said first and second curved doors are in said closed position, and wherein a cover extends between and is coupled with said side walls, and wherein said cover overlies said leading edges when said first and second curved doors are in said closed position.

4. The gate of claim 1, wherein said rail extends in a direction aligned with the direction of movement of said curved door.

5. The gate of claim 1, wherein three rails extend between and are coupled with said end walls adjacent said bottom opening, said rails supporting said curved door.

6. The gate of claim 1, wherein said curved door presents top and bottom surfaces and further comprising:

a first gear rack mounted on said bottom surface extending in a direction aligned with the direction of movement of said curved door;

a first drive shaft extending between said side walls in a direction that is generally perpendicular to the direction of movement of said curved door; and a first gear mounted on said first drive shaft for rotation thereby, said first gear engageable with said first gear rack.

7. The gate of claim 6, further comprising:

a second drive shaft which is generally perpendicular to said first drive shaft; and a first right angle gear box coupling said first and second drive shafts.

8. The gate of claim 7, wherein said bottom opening comprises first and second sections and said curved door comprises a first curved door that blocks said first section when in its closed position, said gate further comprising:

a second curved door supported on said rail and moveable in the opposite direction from said first curved door between a closed position which blocks said second section of said bottom opening and an open position which allows the cargo to exit through said second section of said bottom opening, wherein said second door presents top and bottom surfaces;

a second gear rack mounted on said bottom surface of said second door extending in a direction aligned with the direction of movement of said second door;

a third drive shaft extending between said side walls in a direction that is generally perpendicular to said second drive shaft; and a second gear mounted on said third drive shaft for rotation thereby, said second gear engageable with said second gear rack.

9. The gate of claim 8, further comprising a second right angle gear box coupling said second and third drive shafts.

10. The gate of claim 9, wherein clockwise rotation of said second drive shaft effects a clockwise rotation of said first drive shaft via said first right angle gear box and a counterclockwise rotation of said third drive shaft via said second right angle gear box.

11. The gate of claim 10, wherein clockwise rotation of said second drive shaft moves said first and second curved doors to their open positions.

12. The gate of claim 1, further comprising a flange coupled with said upper surface of said side and end walls, wherein said flange is adapted to be joined to the rim of the car.

13. The gate of claim 12, wherein at least a portion of said first curved door is above said flange when said first curved door is in its open position.

14. A hopper car gate for discharging cargo from a hopper car, said car comprising a hopper having an opening and a rim surrounding said opening, said gate comprising:

opposed generally upright side walls;

opposed generally upright end walls coupled with said side walls, wherein said coupled side and end walls present a top opening, a bottom opening, and an upper surface surrounding said top opening, wherein said upper surface is adapted to be joined to the rim of the car;

a curved rail extending between and coupled with said end walls adjacent said bottom opening;

a curved door supported on said rail and moveable between a closed position which blocks said bottom opening and an open position which allows the cargo to exit through said bottom opening, said curved door presenting top and bottom surfaces;

a first gear rack mounted on said bottom surface extending in a direction aligned with the direction of movement of said curved door;

a first drive shaft extending between said side walls in a direction that is generally perpendicular to the direction of movement of said curved door;

a first gear mounted on said first drive shaft for rotation thereby, said first gear engageable with said first gear rack;

a second drive shaft which is generally perpendicular to said first drive shaft; and a first right angle gear box coupling said first and second drive shafts.

15. The gate of claim 14, wherein said bottom opening comprises first and second sections and said curved door comprises a first curved door that blocks said first section when in its closed position, said gate further comprising:

a second curved door supported on said rail and moveable in the opposite direction from said first curved door between a closed position which blocks said second section of said bottom opening and an open position which allows the cargo to exit through said second section of said bottom opening, wherein said second door presents top and bottom surfaces;

a second gear rack mounted on said bottom surface of said second door extending in a direction aligned with the direction of movement of said second door;

a third drive shaft extending between said side walls in a direction that is generally perpendicular to said second drive shaft; and a second gear mounted on said third drive shaft for rotation thereby, said second gear engageable with said second gear rack.

16. The gate of claim 15, further comprising a second right angle gear box coupling said second and third drive shafts.

17. The gate of claim 16, wherein clockwise rotation of said second drive shaft effects a clockwise rotation of said first drive shaft via said first right angle gear box and a counterclockwise rotation of said third drive shaft via said second right angle gear box.

18. The gate of claim 17, wherein clockwise rotation of said second drive shaft moves said first and second curved doors to their open positions.

19. A hopper car gate for discharging cargo from a hopper car, said car comprising a hopper having an opening and a rim surrounding said opening, said gate comprising:

opposed generally upright side walls;

opposed generally upright end walls coupled with said side walls, wherein said coupled side and end walls present a top opening, a bottom opening, and an upper surface surrounding said top opening;

a flange coupled with said upper surface of said side and end walls, wherein said flange is adapted to be joined to the rim of the car;

a curved rail extending between and coupled with said end walls adjacent said bottom opening; and a curved door supported on said rail and moveable between a closed position which blocks said bottom opening and an open position which allows the cargo to exit through said bottom opening, wherein at least a portion of said curved door is above said flange when said curved door is in its open position.

* * * * *

UNITED STATES PATENT AND TRADEMARK OFFICE

CERTIFICATE OF CORRECTION

PATENT NO. : 7,819,067 B2
APPLICATION NO. : 12/077899
DATED : October 26, 2010
INVENTOR(S) : Stephen R. Early It is certified that error appears in the above-identified patent and that said Letters Patent is hereby corrected as shown below:

Column 8,
Line 41, delete "first" before "curved door".

Column 8,
Line 41, delete "first" between "said" and "curved".

Signed and Sealed this
Eighth Day of February, 2011

David J. Kappos

David J. Kappos
*Director of the United States Patent and Trademark Office*